US009640862B2

(12) United States Patent
Sanford

(10) Patent No.: US 9,640,862 B2
(45) Date of Patent: May 2, 2017

(54) ANTENNA SYSTEM AND METHOD

(71) Applicant: Ubiquiti Networks, Inc., San Jose, CA (US)

(72) Inventor: John R. Sanford, Encinitas, CA (US)

(73) Assignee: UBIQUITI NETWORKS, INC., San Jose, CA (US)

( * ) Notice: Subject to any disclaimer, the term of this patent is extended or adjusted under 35 U.S.C. 154(b) by 191 days.

(21) Appl. No.: 14/524,561

(22) Filed: Oct. 27, 2014

(65) Prior Publication Data

US 2015/0042534 A1 Feb. 12, 2015

Related U.S. Application Data

(63) Continuation of application No. 13/791,163, filed on Mar. 8, 2013, now Pat. No. 8,902,120, and a continuation of application No. 13/366,283, filed on Feb. 4, 2012, now Pat. No. 8,421,704, and a continuation of application No. 12/560,425, filed on Sep. 16, 2009, now Pat. No. 8,184,064.

(51) Int. Cl.

| | |
|---|---|
| ***H01Q 1/42*** | (2006.01) |
| ***H01Q 1/48*** | (2006.01) |
| ***H01Q 19/10*** | (2006.01) |
| ***H01Q 9/04*** | (2006.01) |
| ***H01Q 13/02*** | (2006.01) |
| ***H01Q 19/00*** | (2006.01) |
| ***H01Q 21/06*** | (2006.01) |

(52) U.S. Cl.

CPC ..... *H01Q 1/42* (2013.01); *H01Q 1/421* (2013.01); *H01Q 1/48* (2013.01); *H01Q 9/0407* (2013.01); *H01Q 13/02* (2013.01); *H01Q 19/00* (2013.01); *H01Q 19/10* (2013.01); *H01Q 19/106* (2013.01); *H01Q 21/06* (2013.01); *Y10T 29/49016* (2015.01)

(58) Field of Classification Search

CPC ..... H01Q 1/42; H01Q 1/48; H01Q 9/0407; H01Q 19/106

See application file for complete search history.

(56) References Cited

U.S. PATENT DOCUMENTS 6,067,053 A * 5/2000 Runyon ..... H01Q 1/246 343/700 MS

2007/0046551 A1* 3/2007 Tateno ..... H01Q 1/42 343/713

* cited by examiner

*Primary Examiner* — Hoang Nguyen
*Assistant Examiner* — Michael Bouizza
(74) *Attorney, Agent, or Firm* — Antero Tormey Petrin; Pete Tormey; Shiraun Jacob

(57) ABSTRACT

A conical radiator coupled to an antenna patch disposed along a first end of the radiator, said patch disposed on an insulator. A ground plane is connected to the insulator and a radiomen is disposed opposite a second end of the radiator. The radiomen has a first region presenting a convex surface towards the radiator, and a second region presenting a concave surface towards the radiator. The first end of the conical radiator is the apex of the cone. A ground plane is included and a portion of the ground plane is a planar surface and another portion extends away from the planar portion towards the radiomen. Also disclosed is a method for forming a radiation pattern by shaping the radiomen to effectuate a predetermined radiation pattern using localized convex and concave surfaces positioned on the radiomen at different points in relation to the conical radiator.

10 Claims, 3 Drawing Sheets

ANTENNA SYSTEM AND METHOD

PRIORITY

This application is a continuation of co-pending U.S. patent application Ser. No. 13/791,163 filed Mar. 8, 2013, which is a continuation of Ser. No. 13/366,283 filed Feb. 4, 2012, which in turn is a continuation of U.S. patent application Ser. No. 12/560,425 entitled "Antenna System and Method" by the same inventor file Sep. 16, 2009 all of which are incorporated by reference as if fully set forth herein.

BACKGROUND

The present invention relates generally to antenna structures and more particularly to a system and method for antenna radiation pattern control in a low cost easy to manufacture antenna system.

Wireless fidelity, referred to as "WiFi" generally describes a wireless communications technique or network that adheres to the specifications developed by the Institute of Electrical and Electronic Engineers (IEEE) for wireless local area networks (LAN). A WiFi device is considered operable with other certified devices using the 802.11 specification of the IEEE. These devices allow wireless communications interfaces between computers and peripheral devices to create a wireless network for facilitating data transfer. This often also includes a connection to a local area network (LAN).

Operating frequencies range within the WiFi family, and typically operate around the 2.4 GHz band or the 5 GHz band of the spectrum. Multiple protocols exist at these frequencies and operate with differing transmit bandwidths.

Since antenna placement may adversely affect wireless communications, it is important for an antenna system to provide improved operations under differing physical placement conditions and, if located outside, the antenna must be capable of weathering environmental affects. Generally antenna manufacturers protect the antenna structure by enclosing it in a weather-proof structure often called a radome.

Because the small transmission (TX) power from the transmitters of access points (APs), laptops and similar wireless devices are generally the weakest link in a WiFi system, it is of key importance to utilize high gain antenna systems. Conventionally, designers configure antennas to effectuate a desired radiation pattern. The radiation pattern provides for improved directional ability. This may include shaping the antenna elements or antenna structure so that it radiates radio frequency (RF) energy in a certain direction or pattern. With the advent of low power transmission systems for use in digital networks, communications systems have lacked affordable, easy-to-manufacture antenna systems that provide a wide radiation pattern under adverse conditions.

SUMMARY

Disclosed herein is a conical radiator coupled to an antenna patch disposed along a first end of the radiator, said patch disposed on an insulator. A ground plane is connected to the insulator and a radome is disposed opposite a second end of the radiator. The radome has a first region presenting a convex surface towards the radiator, and the radome has a second region presenting a concave surface towards the radiator. The first end of the conical radiator is the apex of the cone. A ground plane is included and a portion of the ground plane is a planar surface and another portion extends away from the planar portion towards the radome.

In operation, the shape of the radiator, radome and ground plane operate to effectuate an improved radiation pattern by expanding the radiation pattern of a simple patch antenna. The conical radiator provides for lower cost and manufacturability.

Also disclosed is a method for forming an antenna radiation pattern by shaping the radome to effectuate a predetermined radiation pattern. This may be accomplished using localized convex and concave surfaces on the radome and positioning those surfaces at different points in relation to the conical radiator.

The construction and method of operation of the invention, however, together with additional objectives and advantages thereof will be best understood from the following description of specific embodiments when read in connection with the accompanying drawings.

DESCRIPTION

Figure 1:
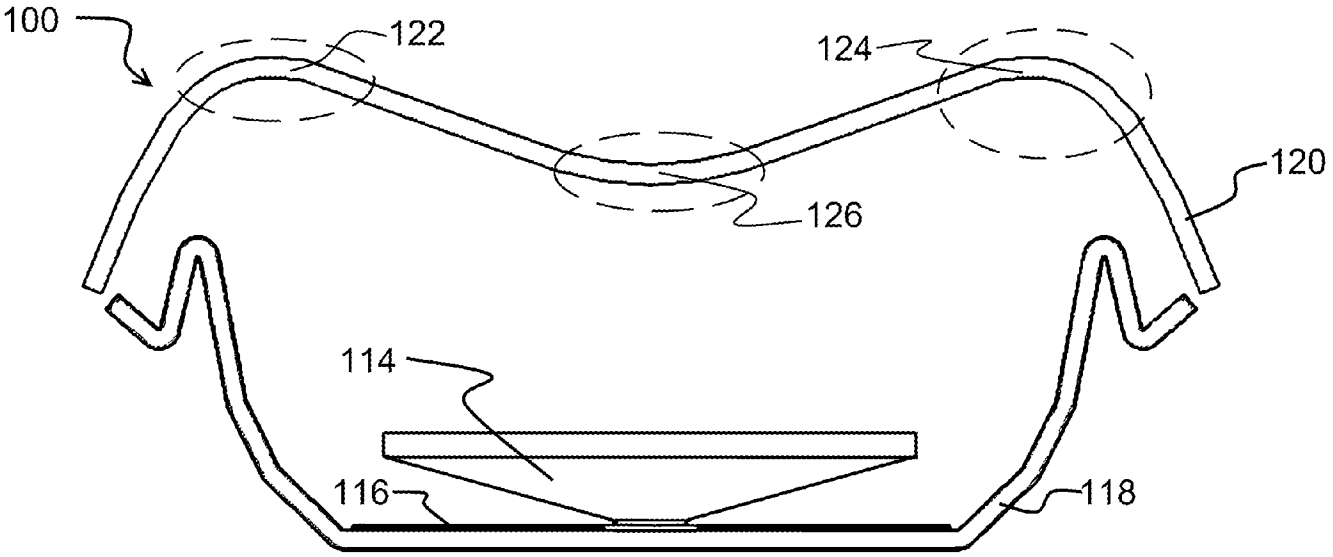
FIG. 1 illustrates a cut-away view of a conical shaped radiator with a radome.

Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Generality of the Description

Read this application in its most general possible form. For example and without limitation, this includes:

References to specific techniques include alternative, further, and more general techniques, especially when describing aspects of this application, or how inventions that might be claimable subject matter might be made or used.

References to contemplated causes or effects, e.g., for some described techniques, do not preclude alternative, further, or more general causes or effects that might occur in alternative, further, or more general described techniques.

References to one or more reasons for using particular techniques, or for avoiding particular techniques, do not preclude other reasons or techniques, even if completely contrary, where circumstances might indicate that the stated reasons or techniques might not be as applicable as the described circumstance.

Moreover, the invention is not in any way limited to the specifics of any particular example devices or methods, whether described herein in general or as examples. Many other and further variations are possible which remain within the content, scope, or spirit of the inventions described herein. After reading this application, such variations would be clear to those of ordinary skill in the art, without any need for undue experimentation or new invention.

Lexicography

Read this application with the following terms and phrases in their most general form. The general meaning of each of these terms or phrases is illustrative but not limiting.

The terms "antenna", "antenna system" and the like, generally refer to any device that is a transducer designed to transmit or receive electromagnetic radiation. In other words, antennas convert electromagnetic radiation into electrical currents and vice versa. Often an antenna is an arrangement of conductor(s) that generate a radiating electromagnetic field in response to an applied alternating voltage and the associated alternating electric current, or can be placed in an electromagnetic field so that the field will induce an alternating current in the antenna and a voltage between its terminals.

The phrase "wireless communication system" generally refers to a coupling of electromagnetic fields (EMFs) between a sender and a receiver. For example and without limitation, many wireless communication systems operate with senders and receivers using modulation onto carrier frequencies of between about 2.4 GHz and about 5 GHz. However, in the context of the invention, there is no particular reason why there should be any such limitation. For example and without limitation, wireless communication systems might operate, at least in part, with vastly distinct EMF frequencies, e.g., ELF (extremely low frequencies) or using light (e.g., lasers), as is sometimes used for communication with satellites or spacecraft.

The phrase "access point", the term "AP", and the like, generally refer to any devices capable of operation within a wireless communication system, in which at least some of their communication is potentially with wireless stations. For example, an "AP" might refer to a device capable of wireless communication with wireless stations, capable of wire-line or wireless communication with other AP's, and capable of wire-line or wireless communication with a control unit. Additionally, some examples of AP's might communicate with devices external to the wireless communication system (e.g., an extranet, internet, or intranet), using an L2/L3 network. However, in the context of the invention, there is no particular reason why there should be any such limitation. For example one or more AP's might communicate wirelessly, while zero or more AP's might optionally communicate using a wire-line communication link.

The term "filter", and the like, generally refers to signal manipulation techniques, whether analog, digital, or otherwise, in which signals modulated onto distinct carrier frequencies can be separated, with the effect that those signals can be individually processed.

By way of example, in systems in which frequencies both in the approximately 2.4 GHz range and the approximately 5 GHz range are concurrently used, it might occur that a single band-pass, high-pass, or low-pass filter for the approximately 2.4 GHz range is sufficient to distinguish the approximately 2.4 GHz range from the approximately 5 GHz range, but that such a single band-pass, high-pass, or low-pass filter has drawbacks in distinguishing each particular channel within the approximately 2.4 GHz range or has drawbacks in distinguishing each particular channel within the approximately 5 GHz range. In such cases, a $1^{st}$ set of signal filters might be used to distinguish those channels collectively within the approximately 2.4 GHz range from those channels collectively within the approximately 5 GHz range. A $2^{nd}$ set of signal filters might be used to separately distinguish individual channels within the approximately 2.4 GHz range, while a $3^{rd}$ set of signal filters might be used to separately distinguish individual channels within the approximately 5 GHz range.

The phrase "isolation technique", the term "isolate", and the like, generally refer to any device or technique involving reducing the amount of noise perceived on a $1^{st}$ channel when signals are concurrently communicated on a $2^{nd}$ channel. This is sometimes referred to herein as "crosstalk", "interference", or "noise".

The phrase "null region", the term "null", and the like, generally refer to regions in which an operating antenna (or antenna part) has relatively little EMF effect on those particular regions. This has the effect that EMF radiation emitted or received within those regions are often relatively unaffected by EMF radiation emitted or received within other regions of the operating antenna (or antenna part).

The term "radio", and the like, generally refers to (1) devices capable of wireless communication while concurrently using multiple antennae, frequencies, or some other combination or conjunction of techniques, or (2) techniques involving wireless communication while concurrently using multiple antennae, frequencies, or some other combination or conjunction of techniques.

The terms "polarization", "orthogonal", and the like, generally refer to signals having a selected polarization, e.g., horizontal polarization, vertical polarization, right circular polarization, left circular polarization. The term "orthogonal" generally refers to relative lack of interaction between a $1^{st}$ signal and a $2^{nd}$ signal, in cases in which that $1^{st}$ signal and $2^{nd}$ signal are polarized. For example and without limitation, a $1^{st}$ EMF signal having horizontal polarization should have relatively little interaction with a $2^{nd}$ EMF signal having vertical polarization.

The phrase "wireless station" (WS), "mobile station" (MS), and the like, generally refer to devices capable of operation within a wireless communication system, in which at least some of their communication potentially uses wireless techniques.

The phrase "patch antenna" or "microstrip antenna" generally refers to an antenna formed by suspending a single metal patch over a ground plane. The assembly may be contained inside a plastic radome, which protects the antenna structure from damage. A patch antenna is often constructed on a dielectric substrate to provide for electrical isolation.

The phrase "dual polarized" generally refers to antennas or systems formed to radiate electromagnetic radiation polarized in two modes. Generally the two modes are horizontal radiation and vertical radiation.

The phrase "radome" generally refers to a weather-proof covering structure placed over and antenna that provides protection of the antenna and allows electromagnetic radiation to pass between the antenna and the atmosphere.

The phrase "patch" generally refers to a metal patch suspended over a ground plane. Patches are used in the construction of patch antennas and often are operable to provide for radiation or impedance matching of antennas.

DETAILED DESCRIPTION

FIG. 1 illustrates a cut-away view of a conical shaped radiator assembly 100. The radiator assembly 100 includes a substantially conical radiator 114 having a base and a vertex end. In operation the vertex end of the conical radiator 114 would be electrically coupled to a final amplifier of a radio transmitter (not shown) such that the apex would function as an antenna feed point or feed area. The radiator 114 could be impedance matched to the amplifier either by constructing the radiator assembly 100 to predetermined dimensions or through an additional circuit (not shown) tuned to the impedance of the transmission system. When the radio transmitter is transmitting, the radiator 114 would be electrically excited at the frequency of transmission and radiate energy away from the radiator 114.

The radiator 114 is mounted on a dielectric surface (not shown) having a metallic patch 116. The dielectric surface is mounted on a conductive ground plane 118. The ground plane 118 provides an electrically grounded surface and is manufactured from a metallic ferrous or other electrically conducting material. Above the radiator 114 is a radome 120. The radome is positioned to cover the conical radiator 114 and may connect to the ground plane 118. The shape of the radome 120 is defined by two peak regions separated by a valley region. The valley region 126 is disposed above the base of the conical radiator 114 approximately in the center of the radome 120. The lowest point of the valley region is aligned to be approximately in line with the vertex of the conical antenna 114 on a line extending perpendicular from the vertex to the base. A first peak region 122 is formed in the radome in a region off of center. Likewise a second peak region 124 is formed in the radome away from the center area.

The ground plane 118 is formed in an extended structure from the apex of the conical radiator 114 up along the sides of the conical radiator 114. At the extended ends of the ground plane 118, the ground plane is formed to bend outward away from the conical radiator 114 creating a directional portion of the ground plane.

In operation, RF energy is applied to the conical radiator 114 and patch 116. When the circuit is tuned, radiation energy is transmitted by the radiator 114 towards the radome 120. The shape of the ground plane prevents or reduces radiation from the radiator 114 through the ground plane by providing a zero potential reference point. In the structure shown in the FIG. 1, almost all RF radiation would pass through the radome 120. An antenna radiation pattern is the direction of radiation measured as degrees azimuth. Measuring the radiation pattern provides for a graphical representation showing an antenna's gain or efficiency in various directions. Typically a radiation pattern is characterized by peaks and nulls. The peaks of the radiation pattern represent areas of optimal antenna reception and transmission (i.e, high gain). Conversely, the nulls of the radiation pattern represent areas of poor antenna reception and transmission (i.e., low gain). The shape of the radome is used to shape the radiation pattern and is determined in response to the shape of the radiator 114.

In the FIG. 1, the radiator 114 may be represented as a circular cone having radiation applied at the apex of the cone. The radome 120 is formed to alter the radiation emitted from the radiator 114 to provide for a more uniform directivity along a desired pattern. The shape of the radome 120 can alter the radiation pattern to allow for RF radiation transmitted from the radiator 114 to reflect (in part) off the radome 120 and exit the structure at a broader angle than if the radome 120 was not present.

One having skill in the art would appreciate that the amount of reflectance or transmittance of the radome 120 is a function of the material used in construction of the radome 120. Conventionally, radomes are made from a durable plastic material designed primarily to protect the antenna from weather and minimize any effect on radiation. Altering the material used in construction of the radome 120 will alter the transmittance and reflectance properties. Additionally, the radome 120 may have regions including ferrous or other EMF sensitive material such that the radome material is not uniform. This may allow for altering radiation directed at the radome in a non-uniform manner. For example, the radome 120 may be formed from a plastic doped with ferrous material around the peak regions 122 and 124, or near the valley region 126 or a combination of the two. Different doping among the doped regions would allow for adjusting the reflectance or transmittance of the radome 120 to meet a desired specification.

References in the specification to "one embodiment", "an embodiment", "an example embodiment", etc., indicate that the embodiment described may include a particular feature, structure or characteristic, but every embodiment may not necessarily include the particular feature, structure or characteristic. Moreover, such phrases are not necessarily referring to the same embodiment. Further, when a particular feature, structure or characteristic is described in connection with an embodiment, it is submitted that it is within the knowledge of one of ordinary skill in the art to effectuate such feature, structure or characteristic in connection with other embodiments whether or not explicitly described. Parts of the description are presented using terminology commonly employed by those of ordinary skill in the art to convey the substance of their work to others of ordinary skill in the art.

Figure 2:
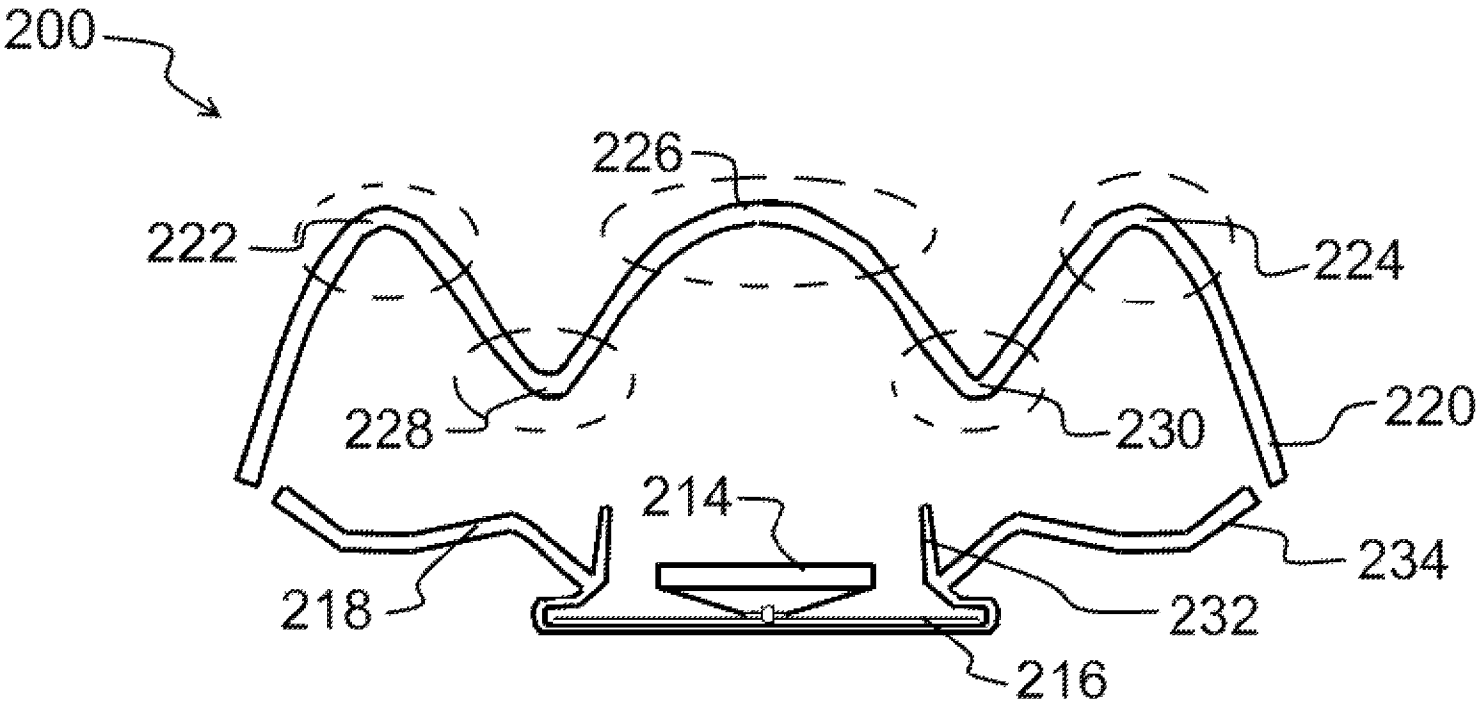
FIG. 2 depicts an antenna assembly according to one aspect of the current disclosure.

FIG. 2 depicts an antenna assembly 200 according to one aspect of the current disclosure. The antenna assembly 200 includes a substantially conical radiator 214 having a base and a vertex end. In operation the apex would be electrically coupled to a final amplifier of a radio transmitter (not shown) such that the apex would function as an antenna feed point or feed area. The radiator 214 could be impedance matched to the amplifier either by constructing the radiator element to predetermined dimensions or through an additional circuit (not shown) tuned to the impedance of the transmission system. When the radio transmitter is transmitting, the radiator 214 would be electrically excited at the frequency of transmission and radiate energy away from the radiator 214.

The radiator 214 is mounted on a dielectric surface and is electrically coupled to a patch 216. The dielectric surface is mounted on a conductive ground plane 218. The ground plane 218 provides an electrically grounded surface and is manufactured from a metallic ferrous or other electrically conducting material. Above the radiator 214 is a radome 220. The radome is positioned to cover the conical radiator 214 and may connect to the ground plane 218. The shape of the radome 220 is defined by three peak regions separated by valley regions. A first peak region 226 is disposed above the base of the conical radiator 214 approximately in the center of the radome 220. The highest point of the peak region 226 is aligned to be approximately in line with the vertex of the conical radiator 214 on a line extending perpendicular from the vertex to the base. A second peak region 222 is formed in the radome in a region off of center. Likewise a third peak region 224 is formed in the radome away from the center area. Two valley regions 228 and 230 separate the peak regions 222, 226 and 224.

The ground plane 218 is formed in an extended planar structure from near the apex of the conical radiator 214, around the dielectric surface where the ground plane is formed into a directional surface extending along the sides of the conical radiator 214. The ground plane 218 has an interior arm 232 disposed alongside the radiator 214 and extending approximately parallel to the direction from the apex to the base of the radiator 214. The ground plane 218 also has an exterior wing 234 extending outward from the radiator 214 in a direction closely transverse to the first wing 232. The exterior wing has a concave region disposed under a peak region of the radome 220.

In operation when RF energy is applied to the conical radiator 214 and the patch 216 and the circuit is tuned, radiation energy is transmitted by the radiator 214 towards the radome 220. The shape of the ground plane 218 prevents or reduces radiation from the radiator 214 through the ground plane by providing a zero potential reference point. In the structure shown in the FIG. 2, almost all RF radiation would pass through the radome 220. The shape of the radome 220 is used to shape the radiation pattern emitted from the radiator 214 and is determined in response to the shape of the radiator 214.

In the FIG. 2, the radiator 214 may be represented as a cone having radiation applied at the apex of the cone. The radome 220 is formed to alter the radiation emitted from the radiator 214 to provide for a more uniform directivity along a desired pattern. The shape of the radome 220 can alter the radiation pattern to allow for RF radiation transmitted from the radiator 214 to reflect (in part) off the radome 220 and exit the structure at a broader angle than if the radome 220 was not present.

Figure 3:
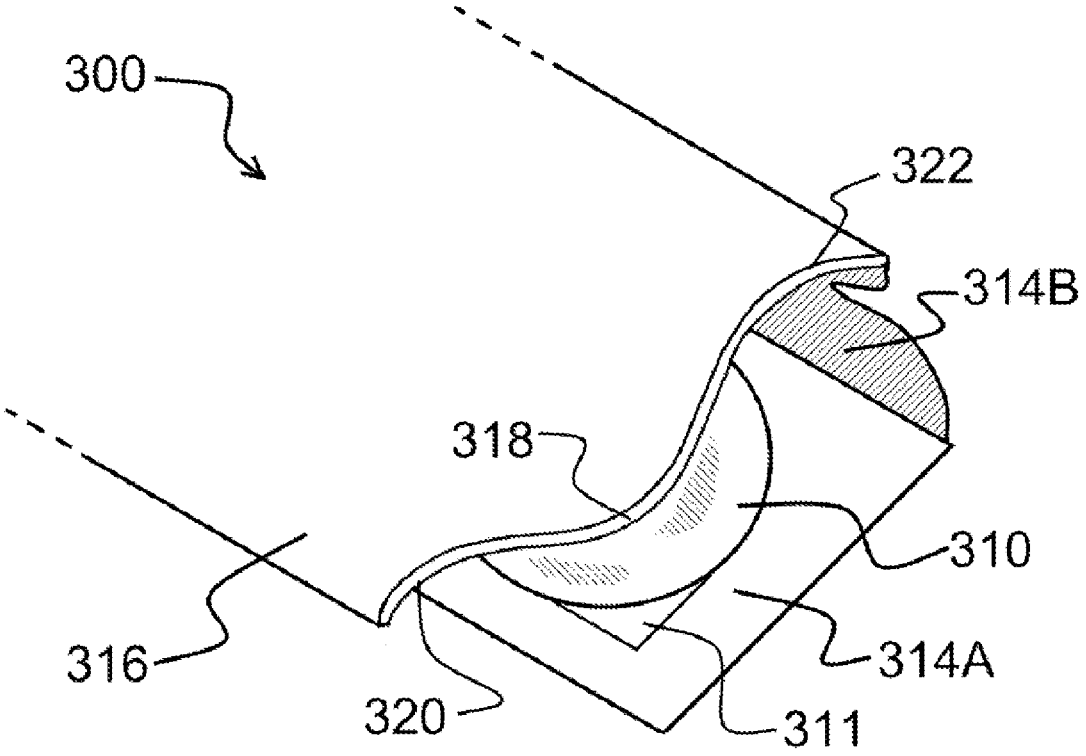
FIG. 3 shows a break away view of an antenna array comprising multiple radiators.

FIG. 3 shows a break away view of an antenna array 300 comprising multiple radiators. In the FIG. 3 multiple radiators 310 (only one partially shown) are electronically coupled to a single radio transmitter (not shown). Each radiator 310 is mounted on a dielectric surface containing a patch 311. The dielectric surfaces are disposed on a ground plane. A portion of the ground plane 314A is disposed beneath the conical radiator 310 on the apex end, while another portion of the ground plane 314B is formed to curve directionally with the radiator and extend above the base end of the conical radiator 310. A radome 316 covers the radiators 310. The radome 316 has one contour comprising a valley region 318 and two peak regions 320 and 322. The valley region 318 is disposed over the center portion of the conical radiator 310 and the peak regions are disposed away from the center portion of the conical radiator 310. With the conical radiator 314 disposed in a linear array, the radome 316 is elongated to cover the multiple radiators 310.

One having skill in the art will recognized that the antenna radiators 310 can be arranged to form a 1 or 2 dimensional antenna array. Each radiator 310 exhibits a specific radiation pattern. The overall radiation pattern changes when several antenna radiators are combined in an array. Disposing the radiators 310 in an array 300 provides for control of the radiation pattern produced by the antenna array. Placement of radiators 310 may reinforce the radiation pattern in a desired direction and suppress radiation in undesired directions. The array directivity increases with the number of radiators and with the spacing of the radiators. The size and spacing of antenna array determines the resulting radiation pattern. The radiators may be sized for proper impedance matching for a communications system, and the spacing between radiators creates the shape of the resulting radiation pattern.

The radome 316 is formed to direct the radiation pattern. Without the radome, radiation would be directed substantially upward, out of the cone through the base portion of the radiator 310. The radome, shaped as shown in the FIG. 3 provides for a partial reflectance of the radiation towards the side of the radome. This has the effect of spreading the radiation away from directly above the cone and towards the sides. This broadens the radiation pattern of the array 300 when compared to a similar array without the radome.

One having skill in the art will recognize that differing radiation patterns may be created by changing the shape of the radome to include shapes such as those expressed in the FIGS. 1 and 2. The location of convex and concave surfaces on the radome alters the shape of the radiation through the radome. To effectuate differing radiation patterns, an antenna designer would measure the radiation pattern from the radiator 310 and adjust the radome characteristics to change the radiation pattern. Alternatively, the radiation pattern may be calculated using conventionally available antenna design software. By way of example, if a designer wants a radiation pattern extending more than 90 degrees (45 degrees from vertical), a structure similar to those of FIG. 1 or FIG. 2 may be employed. The designer can alter the shapes of the convex and concave surfaces to extend the radiation pattern by altering the depth of the concave and convex portions.

It is noted that the ability to shape a radiation pattern to achieve a desired antenna gain provides the ability for wireless communications designers to create more advanced and useful communication tools, especially for ultrahigh frequency and microwave communications systems.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed:

1. A device for enhancing directivity in a desired radiation pattern including:

a ground plane;

a radiator assembly capable of emitting electromagnetic radiation in the desired radiation pattern;

a patch; and, a radome, positioned to cover the radiator assembly and connected to the ground plane, wherein the radiomen includes a valley region approximately in the center of the radiomen, wherein the lowest point of the valley region is aligned with a vertex of the radiator assembly, wherein the radiomen further includes a first and second peak region separated by the valley region.

2. The device of claim 1, wherein the depth of the valley region is chosen such that the desired radiation pattern is enhanced and the directivity of the electromagnetic radiation emitted by the radiator assembly is increased, wherein the height of the first and second peak regions is chosen such that the desired radiation pattern is enhanced and the directivity of the electromagnetic radiation emitted by the radiator assembly is increased wherein the first and second peak regions are chosen in a location off-center with the vertex of the radiator assembly such that the desired radiation pattern is enhanced and the directivity and of the electromagnetic radiation emitted by the radiator assembly is increased.

3. The device of claim 2, wherein the the radiomen is composed partly of nearly radiotransparent material.

4. The device of claim 3, wherein the first and second peak regions are doped with an electromagnetic field-sensitive material such that the transmittance and reflectance properties of the radiomen enhance the directivity of the electromagnetic radiation emitted by the radiator assembly.

5. The device of claim 3, wherein the valley region is doped with an electromagnetic field-sensitive material such that the transmittance and reflectance properties of the radiomen enhance the directivity of the electromagnetic radiation emitted by the radiator assembly.

6. The device of claim 5, wherein the electromagnetic field-sensitive material is a ferrous material.

7. A device for enhancing directivity in a desired radiation pattern including:

a radiator assembly capable of emitting electromagnetic radiation in the desired radiation pattern;

a patch;

a radome; and, a ground plane, positioned to support the radiator assembly, connected to the radiomen and electrically grounded to provide a zero-potential reference point with respect to the radiator assembly;

wherein ground plane extends near the apex of the radiator assembly to beyond the diameter of the base of the radiator assembly.

8. The device of claim 7 wherein the ground plane is formed in an extended sheath structure from the apex of the radiator assembly upward, partially enclosing the radiator assembly such that the ground plane is shaped to reflect electromagnetic radiation emitted from the radiator assembly towards the radiomen in the desired radiation pattern.

9. The device of claim 8 wherein ground plane further includes exterior wings extending outward from the radiator assembly in a direction closely transverse to the interior arms.

10. The device of claim 9 wherein the ground plane includes interior arms disposed alongside the radiator assembly and extending approximately parallel to the direction from the apex of the radiator assembly to the base of the radiator assembly.

* * * * *